US012564213B2

(12) United States Patent
Plattner et al.

(10) Patent No.: US 12,564,213 B2
(45) Date of Patent: Mar. 3, 2026

(54) HEAT-NOT-BURN STICK COMPRISING FOAM-LIKE AEROSOL-GENERATING MATERIAL ARRANGED IN A CONTAINER

(71) Applicant: JT International S.A., Geneva (CH)

(72) Inventors: Michael Plattner, Trier (DE); Paul Black, Schweich (DE); Felicite Maram Diouf, Trier (DE); Daniel Lickefeld, Riol (DE); Peter Uhrmeister, Trier (DE)

(73) Assignee: JT International SA (CH)

( * ) Notice: Subject to any disclaimer, the term of this patent is extended or adjusted under 35 U.S.C. 154(b) by 487 days.

(21) Appl. No.: 17/611,766

(22) PCT Filed: Jun. 19, 2020

(86) PCT No.: PCT/EP2020/067109

§ 371 (c)(1),
(2) Date: Nov. 16, 2021

(87) PCT Pub. No.: WO2020/254582

PCT Pub. Date: Dec. 24, 2020

(65) Prior Publication Data

US 2022/0248745 A1 Aug. 11, 2022

(30) Foreign Application Priority Data

Jun. 21, 2019 (EP) ..... 19181785

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24D 1/04* (2013.01); *A24D 3/17* (2020.01)

(58) Field of Classification Search
CPC ..... A24B 15/167; A24D 1/20
See application file for complete search history.

(56) References Cited

U.S. PATENT DOCUMENTS 9,282,766 B2 * 3/2016 Besso ..... A24D 1/002
10,383,369 B2 * 8/2019 Sebastian ..... A24F 40/44
(Continued)

FOREIGN PATENT DOCUMENTS

EA 201991258 A1 11/2019
JP H11-178562 A 7/1999
(Continued)

OTHER PUBLICATIONS

International Search Report for PCT/EP2020/067109 dated Aug. 28, 2020. 5 pgs.

*Primary Examiner* — Russell E Sparks
(74) *Attorney, Agent, or Firm* — Lerner David LLP

(57) ABSTRACT

An aerosol-generating article includes a charge of aerosol-generating material arranged in a container, wherein the aerosol-generating material is provided in a form of shaped individual elements including a foam-like material. The aerosol-generating article further includes a sealing portion provided to one longitudinal end of the container, and made of an air permeable material and/or having an air permeable structure such that air is capable of flowing therethrough.

19 Claims, 1 Drawing Sheet

(51) Int. Cl.
*A24D 1/04* (2006.01)
*A24D 3/17* (2020.01)

(56) References Cited

U.S. PATENT DOCUMENTS

| | | | | |
|---|---|---|---|---|
| 12,193,488 | B2 * | 1/2025 | Mironov | A24F 40/20 |
| 2010/0024834 | A1 | 2/2010 | Oglesby et al. | |
| 2011/0088708 | A1 | 4/2011 | John et al. | |
| 2014/0345634 | A1 * | 11/2014 | Zuber | A24D 3/17 131/328 |
| 2015/0150302 | A1 | 6/2015 | Metrangolo et al. | |
| 2017/0086508 | A1 | 3/2017 | Mironov et al. | |
| 2017/0318862 | A1 * | 11/2017 | Mironov | H05B 1/0244 |
| 2019/0239555 | A1 | 8/2019 | Nicholson | |
| 2019/0343168 | A1 | 11/2019 | Plattner et al. | |
| 2020/0359675 | A1 * | 11/2020 | Reevell | A24D 1/02 |
| 2021/0084963 | A1 | 3/2021 | Watanabe | |
| 2021/0368860 | A1 | 12/2021 | Reevell | |

FOREIGN PATENT DOCUMENTS

| | | | | |
|---|---|---|---|---|
| JP | 2015-503337 | A | 2/2015 | |
| JP | 6371927 | B1 | 8/2018 | |
| JP | 2019-000119 | A | 1/2019 | |
| JP | 2019524079 | A | 9/2019 | |
| JP | 2021505126 | A | 2/2021 | |
| RU | 2609191 | C2 | 1/2017 | |
| WO | 2017202965 | A1 | 11/2017 | |
| WO | 2018002084 | A1 | 1/2018 | |
| WO | 2018019578 | A1 | 2/2018 | |
| WO | 2018/114380 | A1 | 6/2018 | |
| WO | 2018114441 | A1 | 6/2018 | |
| WO | WO-2018122375 | A1 * | 7/2018 | A24B 15/16 |
| WO | 2019/030276 | A1 | 2/2019 | |
| WO | 2019030277 | A1 | 2/2019 | |
| WO | 2019110747 | A1 | 6/2019 | |

* cited by examiner

HEAT-NOT-BURN STICK COMPRISING FOAM-LIKE AEROSOL-GENERATING MATERIAL ARRANGED IN A CONTAINER

CROSS-REFERENCE TO RELATED APPLICATIONS

The present application is a national phase entry under 35 U.S.C. § 371 of International Application No. PCT/EP2020/067109, filed Jun. 19, 2020, published in English, which claims priority to European Application No. 19181785.7 filed Jun. 21, 2019, the disclosures of which are incorporated herein by reference.

TECHNICAL FIELD OF THE INVENTION

The present invention relates to the field of tobacco, especial tobacco-containing foam-like or mousse-like aerosol-generating material for use in a heat-not-burn article. The aerosol-generating material is provided within a container housed within portion of a heated aerosol-generating article for smoking.

BACKGROUND OF THE INVENTION

Aerosol-generating articles comprising aerosol-generating material used in a heat-not-burn (HnB) smoking device have been known since 1980. It is nonetheless only becoming more popular since the turn of the 21$^{st}$ century, as studies have shown that HnB vapour releases significantly less of most of the chemicals in tobacco smoke. Moreover, none of the combustion emission process occurs when the HnB smoking articles are used in the HnB holder. Hence, it is generally agreed that the aerosol generated is not smoke, and thus such a smoking article could be better known as an aerosol-generating article.

Commercially available HnB systems include a charger, a holder and tobacco sticks, plugs or capsules. Inserted into the holder, tobacco sticks are heated with an electronically controlled heating element.

Patent document US20150150302 relates to a rod for use as an aerosol-generating article, comprising at least two sheets of tobacco material gathered together and circumscribed by a wrapper, wherein the sheets of tobacco material may be physically or chemically different to each other. The sheets of tobacco material may have the same thickness or different thickness or be crimped. The aerosol-generating substrate is provided to a portion where it is in direct contact with a heat source.

Patent document WO 2017/202965 relates to a method for providing an aerosol-generating device for use with an article such as a shape-transformable aerosol-forming substrate. The article has a layer of aerosol-forming substrate and a second layer which is an open layer, for example a mesh arrangement. The open layer allows air and aerosol or evaporated substances from the substrate to enter inside the aerosol-generating article as well as into the open layer. The article can further be provided with outer paper layers, for example cigarette paper, on top of the open layer and below the aerosol-forming substrate layer.

US 2011/088708 A1 describes smokable filler materials and a process for making the same, wherein the smokable filler material comprises a foaming agent, an agent capable of forming chemical cross-linkages, and a cross-linking agent. It is disclosed that the smokable filler material is a self-supporting foam when dried. Advantageously, drying of the stabilised foamed material further stabilises the foamed structure and enables further processing thereof. Moreover, it is disclosed therein that in order to maintain stabilisation, the foamed material is dried.

Even though existing HnB aerosol-generating materials and articles are becoming more and more popular, consumers at the same time acknowledge that they do not offer a comparable taste and sensory experience to conventional smoking articles such as cigarettes or cigars. In particular, consumers find currently available products to lack real tobacco taste.

In addition, existing heat-not-burn products and devices require heating the reconstituted tobacco material to very high temperatures, above 300° C. and up to 350° C., which requires thermally insulating the heating devices to avoid harming consumers in the first place, but also to cool the generated aerosol before inhalation by consumers, which is usually achieved by means of polylactic acid (PLA) pleated films introduced in the filter of the heated aerosol-generating articles.

It would thus be advantageous to provide consumers with aerosol-generating articles and materials providing a more pleasant taste experience, closer to real tobacco, to consumers, and further requiring less heating for aerosol-generation and thus less cooling thereof for consumption.

SUMMARY OF THE INVENTION

The inventors of the present invention have found solutions to the above-discussed problems through a new and inventive aerosol-generating article as defined in the claims.

A first aspect of the invention is accordingly to provide an aerosol-generating article, comprising a charge of aerosol-generating material arranged in a container, wherein the aerosol-generating material is provided in form of shaped individual elements comprising a foam-like material, wherein the aerosol-generating article further comprises a sealing portion provided to one longitudinal end of the container, and made of an air permeable material and/or has an air permeable structure such that air is capable of flowing therethrough.

Thanks to the novel aerosol-generating article, the inventors have surprisingly found out that the aerosol-generating article of the present invention has a number of advantages. A first advantage is that the foam-like material contained in the container undergoes lesser direct heating, hence a lower and more adequate temperature (e.g. less than 300° C.) for heating the foam-like aerosol-generating material is provided thanks to airspaces arranged between the shaped individual elements. Moreover, chunks or debris generated from the aerosol-generating material heated by the heating element is contained predominantly within the container. This has the advantage of significantly reducing the number of times needed to clean the heating element of an HnB heating device or holder after use. Moreover, the sealing portion which only allows air flowing therethrough serves as a good barrier to block any aerosol-generating material chunks that is provided to the aerosol-generating article, in particular from aerosol-generating material contacting a heating element of a heating device, to fall away from the inventive article to the heating device being used with or on a user's garment especially upon removal from (or withdrawal of) the heating element (blade). After consumption, the consumed article is removed from the heating device and the sealing portion then acts as a wiping member along the heater member to remove any attached aerosol-generating material, such that the surface of the heating element remains free (or has only very minimal traces of) from debris of the aerosol-generating material. This has the advantage of significantly reducing the number of times to clean the heating element of a heating device after use.

According to one preferred embodiment, the container is air permeable. This has the advantage that heated air can pass through the container, thereby a charge of aerosol can be released from the container to the mouthpiece end when in use.

According to another preferred embodiment, the container comprises air permeable material and/or an air permeable structure such as micro holes or mesh. Such material or feature allows heated air to pass through the container, thereby a charge of aerosol can be released from the container to the mouthpiece end when in use.

In another embodiment, the air permeable material is selected from the group consisting of cellulose acetate, paper, metal, heat resistant plastic, activated charcoal, or a combination thereof.

In another preferred embodiment, the aerosol-generating material comprises a tobacco originating agent having a weight of 0.1-66 wt. % of the weight of the foam, preferably 0.1-33 wt. % of the weight of the foam.

According to another embodiment, the tobacco originating agent is selected from the group consisting of tobacco, tobacco flavour, nicotine, and derivatives of nicotine.

In yet another embodiment, the aerosol-generating material further comprises an aerosol-forming agent, a foam stabilizing agent, and a foam forming agent, wherein the aerosol-forming agent preferably has a weight of 10-80 wt. %, preferably 30-70 wt. % of the weight of the foam.

In another preferred embodiment, the container comprises a tubular wall made of a material selected from the group consisting of paper, metal, plastic, silica or a combination thereof.

In another embodiment, the container is filled up at most 95%, preferably 90%, 80%, 70%, 60% or 50% of the space. For instance, the inventor has found out that when approximately 70% of the space of the portion housing the containers having aerosol-generating material, an optimum air flow can be achieved. Users of the aerosol-generating article generally experience a smooth and tobacco-rich taste experience. When approximately 90% of the space of the portion is filled with the containers having aerosol-generating material, a strong taste experience close to real tobacco can generally be experienced by most of the users.

According to yet another embodiment, the aerosol-generating material comprises a plurality of individual elements shaped in form of pods, granules, elongated fibres, elongated spirals or a combination thereof. The inventor found out that while individual elements having different shapes in general do not significantly differ in the sensory taste experience, however individual elements having elongated shapes may be preferred as it is easier to be produced (e.g. via extrusion). To the contrary, individual elements having granular shapes allows sufficient gaps for air flow, thus users generally have a better inhaling experience.

In another particularly preferred embodiment, the aerosol-generating material comprises a bundle of elongated fibres, wherein each elongated fibre has an average diameter of between 0.3 and 5 mm, preferably between 0.5 and 1 mm.

In one particularly preferred embodiment, the aerosol-generating article further comprises a filter attached at a longitudinal end of the container.

According to yet another preferred embodiment, the filter comprises cellulose acetate, paper, heat resistant plastic or polymer, activated charcoal, a flavourant, or a combination thereof.

According to one preferred embodiment, the sealing portion is configured in such a way that air is capable of flowing from said first longitudinal end of the elongated portion to the second longitudinal end. The sealing portion may be made of a gel, silica, gum, slurry, matrix or the like.

According to some preferred embodiments, the containers are arranged in such a way that the longitudinal end of the container is substantially parallel to the longitudinal end of the aerosol-generating article. In this way, the sealing portion is thereby provided to one longitudinal end.

In one further variant of the invention, the mouthpiece portion is attached at the second longitudinal end of the elongated portion opposite the sealing portion. In other words, the mouthpiece portion is preferably provided on one longitudinal end of an aerosol-generating article whereas the sealing portion is provided on another longitudinal end of the aerosol-generating article.

In one embodiment, a portion is provided to the aerosol-generating article, preferably in between a mouthpiece portion and a sealing portion, wherein the containers housing the aerosol-generating material are contained within said portion of the aerosol-generating article.

To this end, it is reiterated that throughout the present application, the expression "longitudinal end of the container" does not strictly refer literally only to the container but rather to the end opposite the filter part, by default. In other words, the longitudinal end is referred being parallel to the longitudinal end of the aerosol-generating article, so that the sealing portion is provided to one longitudinal end, and the mouthpiece section is provided to another longitudinal end (of the aerosol-generating article, as shown in the figure). The aerosol-generating material portion being provided in therebetween.

By "about" or "approximately" in relation to a given numerical value, it is meant to include numerical values within 10% of the specified value. All values given in the present disclosure are to be understood to be complemented by the word "about", unless it is clear to the contrary from the context.

The indefinite article "a" or "an" does not exclude a plurality, thus should be treated broadly.

Unless defined otherwise, technical and scientific terms used herein have the same meaning as commonly understood by one of ordinary skill in the art to which this invention belongs.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis.

As used herein, the term "container" refer to a hollow object, in form of such as a box or a housing which can be used for holding one or more elements therein, especially for carrying or storing. The material forming the container is different to the material of the element which is contained within the container.

As used herein, the term "foam" is used interchangeably with the term "mousse". The foam of the present invention is an open pored foam according to certain embodiments. An open pored foam as used herein is to be understood as a foam which can be considered as being formed of a plurality of interconnecting pores (formed out of a structural material derived from the foam forming agent cooperating with the interacting components such as the foam stabilizing agent, solid components such as tobacco particles and some solvent, etc.) which are able to contain fluid, in particular a mixture of humectant/liquid aerosol-forming substrate and air, wherein at least a significant portion (e.g. greater than 50% by volume) of the pores in the foam are fluidly connected with each other, contrary to a closed-cell foam, wherein the majority of the pores form discrete pockets, each completely enclosed by pore-forming material so as to substantially prevent fluid from passing freely between pores. It is currently believed that the foams, particularly mousses, formed as described herein are largely open-pored foams, particularly mousses, because after heating the foam, particularly mousse, to release vapour, substantially all of the humectant appears to be released based on measuring the weight of the foam, particularly mousse, portion before and after heating, which could not be readily explained if the humectant was not able to travel through neighbouring pores to reach the surface of the foam, particularly mousse, portion. However, alternative explanations cannot be totally excluded—for example closed pores could perhaps be opened by rupturing a closed cell wall as a result of the pressure of vaporized gas, etc. For example, according to the definition of the present invention, the term "foam" cannot be equate to terms like gel, cream or slurry.

A tobacco ingredient containing agent can be any compound, mixture, particle matter, and/or solution that contains and/or carries a constituent of tobacco, either artificially included or naturally contained in tobacco, e.g. tobacco, tobacco particles, tobacco flavour and/or nicotine. In contrast, an example for an artificially added non-tobacco-specific flavour would be menthol.

As used herein, the term "heated aerosol-generating article" refers to an aerosol-generating article for producing an aerosol comprising an aerosol-generating material that is intended to be heated rather than combusted in order to release volatile compounds that can form an aerosol.

As used herein, the term "aerosol-generating material" refers to a material capable of releasing upon heating volatile compounds, which can form an aerosol. The aerosol generated from aerosol-generating material of aerosol-generating articles described herein may be visible or invisible and may include vapours (for example, fine particles of substances, which are in a gaseous state, that are ordinarily liquid or solid at room temperature) as well as gases and liquid droplets of condensed vapours.

An aerosol-forming agent can be any compound, mixture and/or solution that is capable of forming an aerosol, e.g. when heated and/or in mixture with a tobacco ingredient containing agent. Well known examples include humectants such as glycerin and propylene glycol, other alcohols, such as ethanol, etc.

As used herein, wt. % is to be understood as weight percent, based on the total weight of the foam, unless explicitly otherwise specified. In the present disclosure, all amounts are given in wt. %, unless clearly stated otherwise or obvious from context. In the present disclosure, furthermore all amounts given in wt. % in a particular foam add up to 100 wt. %. The weight percent are thereby calculated by dividing the mass of each component by the total mass of the foam, unless indicated otherwise or clear from context.

DETAILED DESCRIPTION OF THE INVENTION

Figure 1:
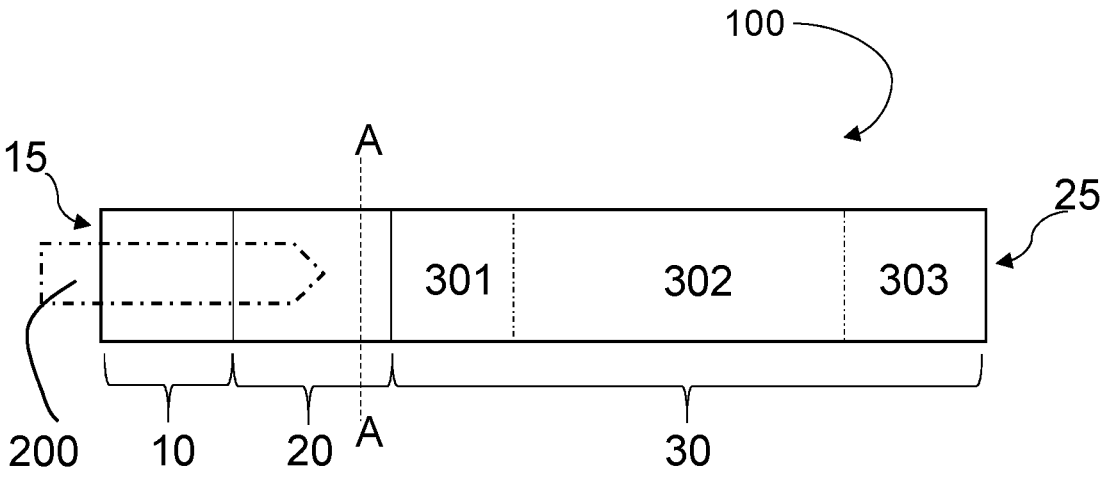
FIG. 1 shows a schematic representative of an aerosol-generating article according to an embodiment of the present invention.

FIG. 1 shows an exemplary embodiment of an aerosol-generating article 100 according to the present invention. The aerosol-generating article 100 has a cylindrical shape which is similar to the currently marketed heat-not-burn articles.

The aerosol-generating article 100 comprises a plurality of portions 10, 20, 30 arranged longitudinally in an end to end fashion. One longitudinal end of the aerosol-generating article 100 represents a distal end 15 whereas another longitudinal end of the aerosol-generating article 100 represents a proximal, mouth end 25. In the embodiment shown in FIG. 1, the aerosol-generating article 100 comprises a sealing portion 10, an aerosol-generating material portion 20, and a mouthpiece portion 30. These portions 10, 20, 30 can be attached in abutment together by one or several wrappers, forming an elongated, substantially cylindrical aerosol-generating article.

It shall also be noted that the mouthpiece section 30 may itself be formed of either a single segment of filter material, for example of cellulose acetate as known from conventional cigarettes, or of a plurality of segments adjoined together conventionally with one or several plug wraps, to form a multi-segments mouthpiece. Such multi-segments mouthpiece may in particular comprise a centre hole acetate segment 301 contacting the aerosol-generating material portion 20, then an aerosol-cooling portion 302, for example formed of pleated polylactic acid (PLA) film, and a mono-acetate filter portion 303 at the mouthpiece end 25, which mouth end filter segment 303 may comprise one or more flavour-releasing elements such as a capsule or a thread (cf. FIG. 1).

In use, the aerosol-generating article 100 is inserted into a vaporizer or heating device comprising a heater such that at least the aerosol-generating material portion 20 cooperates with a heating element 200. When the heating element 200 is a heating blade or rod element, it pierces for example through from the distal end 15 of the aerosol-generating article 100 and the aerosol-generating article 100 is slid onto the heating element until the latter extends into portion 20 to heat up tobacco-containing aerosol-generating materials contained therein. The aerosol-generating article 100 is designed in such a way that aerosol generated upon heating the aerosol-generating material in portion 20 is permissible to flow longitudinally from the distal end 15 to the mouth end 25 when a user draws or sucks from the mouth end 25 through the mouthpiece when in use.

The sealing portion 10 serves as an additional shield in addition to the container 22 such that the chunks or debris from the aerosol-generating material 65 will not be withdrawn together with the heating element 200 when the aerosol-generating article 100 is being pulled out from the holder of the smoking device.

Figure 2:
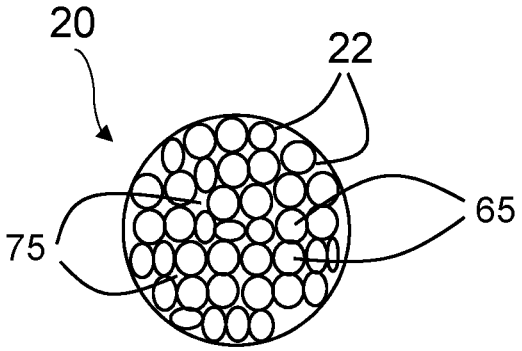
FIG. 2 shows a cross sectional view of the portion housing containers, wherein the aerosol-generating material is contained in the containers.

FIG. 2 shows a cross sectional view of the aerosol-generating material portion 20 of the FIG. 1 (dotted line A-A). Said aerosol-generating material portion 20 comprises a plurality of containers 22, housing a charge of aerosol-generating material 65 in a foam-like structure. The containers 22 may be provided in an air permeable structure such as mesh or is made up with an air permeable material such as paper. It can also be foreseen that the containers 22 are possible to be made of a heat-conductive material, in particular a metal such as aluminium, zinc, copper, brass or chromium steel so as to be heat conductive in order to allow transfer of heat, essentially by conduction, from a heating element of a heating device to the foam-like aerosol-generating material 65 to generate an aerosol.

The foam-like material 65 may comprise tobacco-containing material, and preferably is a foam-like aerosol-generating material 65 as described in WO 2018/122375 A1 and is housed within the container 22 at an average quantity of approximately 100-1000 mg, preferably approximately 250-400 mg of aerosol-generating material per portion. For instance, when a portion of the smoking article has a weight of between 300 mg, only approximately of 50 mg to 60 mg thereof are tobacco-containing material.

In this particular embodiment, the cross section (dotted line A-A) of the portion 20 shows that the container 22 are in substantially circular shapes. In other words, the containers 22 can be provided as granules, pods, disc, elongated fibres, elongated spiral or the like. For instance, container 22 in form of elongated fibre or elongated spiral has the advantages of increased processability, simplicity (produced via extrusion), easier control of density and air flow.

Advantageously, one or more airflow channels 75 are arranged longitudinally in the longitudinal direction of the aerosol-generating article 100. This allows aerosol circulation and insertion of the article onto a blade or rod like heating element 200 of a heating device when such is used in conjunction with the inventive article 100 for heating it.

To this end, it is disclosed that the aerosol-generating material 65 which is foam-like or mousse-like material, preferably comprises tobacco-containing or originating material, i.e. material derived from real tobacco plants or seeds. The aerosol-generating material 65 can be provided to the containers 22 via different methods well known to a skilled person in the art.

Thanks to the novel aerosol-generating article, the inventors have surprisingly found out that aerosol-generating material which is in form of a foam-like or mousse-like, wherein the foam-like material is housed within a container 22, a more homogenised form of tobacco-containing materials can be achieved and provided. Such aerosol-generating article advantageously provides a denser, tobacco-flavour rich, homogenous aerosol, which offers consumers a better user's experience compared to reconstituted tobacco. For example, the aerosol-generating article of the present invention permits aerosol delivery for up to 15-20 puffs with prominent tobacco character, requiring however very little tobacco material (e.g. only 60 mg of tobacco-containing material of a 250-400 mg portion).

In the preferred embodiment of FIG. 1, the sealing portion 10 is provided to the aerosol-generating article 100 of the present invention at the furthest portion from the mouth end 25. The sealing portion 10 may comprise a solid material such as gel, gum, matrix or slurry.

As described above, a heating blade 200 or rod element 200 of a vaporizer or a heating device may pierce through the sealing portion 10 and reach the portion 20 comprises a plurality of containers 22, wherein the heating element 200 is in contact with the foam-like material 65 provided within the containers 22, thereby producing a charge of aerosol, as the foam-like material 65 is heated by the heating element 200. Although it is not intended, traces of debris are usually formed from the heated foam-like aerosol-generating article 100 and these traces of debris or chunks are often stuck to the surface of the heating element 200 of the smoking device. For this reason, the user needs to clean frequently the smoking device.

The sealing portion 10 can be provided to the aerosol-generating article 100 of the present invention to clean the heating blade or rod element (e.g. being discarded) upon withdrawal of the article 100 from the heating blade or rod element, thereby preventing the aerosol-generating material 65 or its debris from leaving the portion 20 where containers 22 having aerosol-generating material 65 are being contained. For this reason, the heating element 200 can be cleaned automatically by the sealing portion 10 when being retrieved from the aerosol-generating article 100, thus reducing the frequency of cleaning the surface of the heating blade element of the smoking device. To this end, it is disclosed that the material chosen to form the sealing portion 10 should be able to the heat of the heating element 200, for example at least 500° C. and up to 1000° C.

Thanks to the containers 22 where the aerosol-generating material 65 in form of foam-like or mousse-like is housed therein, the heat of the heating device is not directly transferred to the aerosol-generating material 65. The inventor of the present invention has found out that the foam-like aerosol-generating material 65 contained in the container 22 is indirectly heated by the heating element 200 and has a temperature of approximately 230° C. when in use. This temperature is ideal for the foam-like material to release charge of aerosol.

It is reiterated herein again that one or more air channel 75 provided through the containers 22 are preferably parallel to the longitudinal direction of the aerosol-generating article 100 such that air can be flown from a distal end 15 to the mouth end 25 of the mouthpiece 30 of the aerosol-generating article 100 for a user to draw the aerosol through the mouthpiece when in use.

It will be appreciated that the aerosol-generating article 100 show in the FIG. 1 may also be suitable for use with any types of existing heat-not-burn aerosol-generating devices, in particular but not exclusively comprising blade or rod heating elements inserted into a charge of aerosol-generating material or peripheral wrapped in a rod shape together with a mouthpiece.

The invention claimed is:

1. An aerosol-generating article, comprising:

a plurality of containers each housing a charge of aerosol-generating material in a form of a shaped individual element comprising a foam material, and a sealing portion provided to one longitudinal end of the plurality of containers, and made of an air permeable material and/or having an air permeable structure such that air is capable of flowing therethrough, wherein the plurality of containers and the sealing portion are attached in abutment together by one or several wrappers to form an elongated, substantially cylindrical structure.

2. The aerosol-generating article according to claim 1, wherein each container is distinct from the sealing portion and is air permeable.

3. The aerosol-generating article according to claim 2, wherein each container is distinct from the sealing portion and comprises an air permeable material and/or an air permeable structure.

4. The aerosol-generating article according to claim 1, wherein the air permeable material is at least one of cellulose acetate, paper, metal, heat resistant plastic, activated charcoal, or a combination thereof.

5. The aerosol-generating article according to claim 1, wherein the aerosol-generating material comprises a tobacco originating agent having a weight of 0.1 66 wt. % of a weight of the foam material.

6. The aerosol-generating article according to claim 5, wherein the tobacco originating agent is at least one of tobacco, tobacco flavour, nicotine, or derivatives of nicotine.

7. The aerosol-generating article according to claim 1, wherein the aerosol-generating material further comprises an aerosol-forming agent, a foam-stabilizing agent, and a foam-forming agent, wherein the aerosol-forming agent has a weight of 10-80 wt. % of a weight of the foam material.

8. The aerosol-generating article according to claim 1, wherein each container comprises a tubular wall made of a material, wherein the material is at least one of paper, metal, plastic, silica or a combination thereof.

9. The aerosol-generating article according to claim 1, wherein each container is filled up to at most 95% of a space therein.

10. The aerosol-generating article according to claim 1, wherein the shaped individual elements of the aerosol-generating material are in a form of pods, granules, elongated fibres, elongated spirals or a combination thereof.

11. The aerosol-generating article according to claim 10, wherein the shaped individual elements of the aerosol-generating material together comprise a bundle of elongated fibres, wherein each elongated fibre has an average diameter of between 0.3 and 5 mm.

12. The aerosol-generating article according to claim 1, further comprising a filter attached at a longitudinal end of the plurality of containers.

13. The aerosol-generating article according to claim 12, wherein the filter comprises cellulose acetate, paper, heat resistant plastic or polymer, activated charcoal, a flavourant, or a combination thereof.

14. The aerosol-generating article according to claim 1, wherein the sealing portion is provided with gel, silica, gum, slurry, or matrix.

15. The aerosol-generating article according to claim 3, wherein each container comprises the air permeable structure, and the air permeable structure is micro holes or mesh.

16. The aerosol-generating article according to claim 1, wherein the aerosol-generating material further comprises an aerosol-forming agent, a foam-stabilizing agent, and a foam-forming agent, wherein the aerosol-forming agent has a weight of 30-70 wt. % of a weight of the foam material.

17. The aerosol-generating article according to claim 1, wherein one or more airflow channels are arranged longitudinally in a longitudinal direction of the aerosol-generating article between the shaped individual elements.

18. The aerosol-generating article according to claim 1, wherein 30% of the space of an aerosol-generating material portion housing the plurality of containers is unfilled.

19. An aerosol-generating article, comprising:

a plurality of containers each housing a charge of aerosol-generating material in a form of a shaped individual element comprising a foam material, and a sealing portion provided to one longitudinal end of the plurality of containers, and made of an air permeable material and/or having an air permeable structure such that air is capable of flowing therethrough, wherein the plurality of containers each housing the charge of aerosol-generating material forms an aerosol-generating material portion, and wherein the sealing portion, the aerosol-generating material portion, and a mouthpiece portion of the aerosol-generating article are attached in abutment together by one or several wrappers.

* * * * *